United States Patent [19]

Royer

[11] 4,293,733

[45] Oct. 6, 1981

[54] SAFETY COVER FOR ELECTRICAL OUTLETS

[75] Inventor: George R. Royer, Toledo, Ohio

[73] Assignee: John A. Weithman, Genoa, Ohio ; a part interest

[21] Appl. No.: 93,608

[22] Filed: Nov. 13, 1979

[51] Int. Cl.[3] ..... H01R 13/44

[52] U.S. Cl. ..... 174/67; 339/36

[58] Field of Search ..... 174/66, 67; 220/241, 220/242; 339/36, 37, 38, 39, 40, 41, 42, 43, 44, 123

[56] References Cited

U.S. PATENT DOCUMENTS

| | | | |
|---|---|---|---|
| 3,363,216 | 1/1968 | Benedetto | 174/67 X |
| 3,449,706 | 6/1969 | Carissimi | 174/67 X |

FOREIGN PATENT DOCUMENTS

| | | | |
|---|---|---|---|
| 2271680 | 12/1975 | France | 339/41 |
| 633914 | 2/1962 | Italy | 339/41 |

*Primary Examiner*—Gene Z. Rubinson

*Assistant Examiner*—D. A. Tone

[57] ABSTRACT

The subject invention is a protective safety cover for electrical outlets of the type affixed to the side of a wall or other building appurtenance. The subject outlet cover is a device to protect infant or young children from pulling electrical appliance plugs as inserted in electrical outlets, and comprises a solid plate member, said plate member being adapted to be inserted in place of or over the existing outlet cover. In addition, the subject plate member is provided with appropriately positioned circular openings which correspond in positioning to the respective plug receptacles. These circular openings are of sufficient diameter to receive a plug of an electrical appliance so as to enable same to reach the respective plug receptacles. Projecting outwardly from the circular openings in this plate member are hollow cylindrical members which are adapted to surround the plug when inserted position in the socket, the latter cylindrical member being adapted to cover the plug and its respective prongs when inserted in the plug receptacle.

4 Claims, 5 Drawing Figures

SAFETY COVER FOR ELECTRICAL OUTLETS

DISCUSSION OF PRIOR ART

The subject invention pertains to wall type outlet sockets for electrical outlets of the type that receive the prongs of a plug on an electrical cord which lead from a connected electrical appliance. The invention is directed to safety covers for such electrical outlets as indicated are adapted to receive a prong type plug for purposes of completing an electrical circuit to a corresponding electrical appliance. More particularly, the invention is directed to a safety cover plate adapted to prevent young children from pulling plugs from the electrical outlet receptacle. The invention is also adapted to prevent children playing with and touching partially exposed prongs on an appliance plug incompletely inserted, in order to avoid the potential of electrical shock.

As implied above, one of the problems encountered with the use of wall type electrical outlets is that young children frequently try to pull either an appliance plug while it is in the socket, or alternately they may try to play with a plug while the prongs are only partially inserted in the socket. Obviously, there is a danger involved in any such attempted manipulations of a plug by a child, particularly at times when the plug is partially inserted with the metal conducting prongs partially exposed. Another aspect of particular concern is the possibility of a child putting part of his finger into an empty outlet receptacle. Yet another concern arises when a child plays with a plug, partially disengaging same from the outlet, as in such case there is the attendant potential danger of the child touching one of the metal prongs while it is still partially connected. This latter situation can lead to the potential of electrical shock. All of these foregoing dangers are increased in intensity and potential harmful effect whenever a child's hands are wet, as the moisture augments the electrical shock potential.

Protecting children from such electrical dangers is not an easy task to overcome, since appliance plugs necessarily project outwardly into a room from the wall socket, with the corresponding electrical cord trailing behind. Since most of these outlets are positioned relatively low on the wall, they are accessible to small children. Moreover, so long as the insertible male plug is used under existing circumstances, the temptation of children to remove will be omnipresent, and therefore certain safety precautions must be used for protection purposes.

In attempt to alleviate this problem to some degree, certain devices have been conceived as a measure to discourage children from playing with such plugs in the outlets. One such known protective device is a plastic plug with a flat face and two male prongs, the entire device being composed of a non-conducting material. This latter device is designed to be inserted in an unused electrical outlet to discourage or keep children from placing their fingers into the female receptables to avoid electrical shock. One of the limitations of such a device is that children can easily pry them out of the sockets, and thereupon its utility is negated completely. Moreover, such insertible devices are not conceived or structured to protect against children prying out an already inserted plug and manipulate it in the partially unpluged position, as discussed above. As stated, this latter aspect may be more of a potential danger then the problem of exposed outlets. As a result, there is a need for an auxiliary device for protection against all the foregoing dangers, and the subject device is conceived to protect against all such dangers and the following objects of the invention are directed accordingly.

OBJECTS

In view of the foregoing, it is an object of the subject invention to provide an improved safety device for wall type electrical outlets;

It is also an object of the subject invention to provide a safety device for a wall type electrical receptacle;

Yet another object of the subject invention is to provide a safety device for attachment to a wall type electrical outlet to prevent children from pulling plugs and placing their fingers into outlet receptacles or on any partially exposed plug prongs;

Still another object of the subject invention is to provide an improved safety feature for electrical outlets for prevention of children endangering themselves;

A further object of the subject invention is to provide an improved cover plate for electrical outlets;

Another object of the subject invention is to provide an improved safety device;

Still another object of the subject invention is to provide an improved electrical safety device;

Another object of the subject invention is to provide a device for limiting a child's access to electrical outlets or appliance plugs when inserted in an outlet receptacle;

Other objects of the subject invention include the concept of improving safety for electrical outlets;

Other and further objects of the subject invention will become manifest upon review of the following description taken in conjunction with the claims.

DRAWINGS

DESCRIPTION OF GENERAL EMBODIMENT

Figure 3:
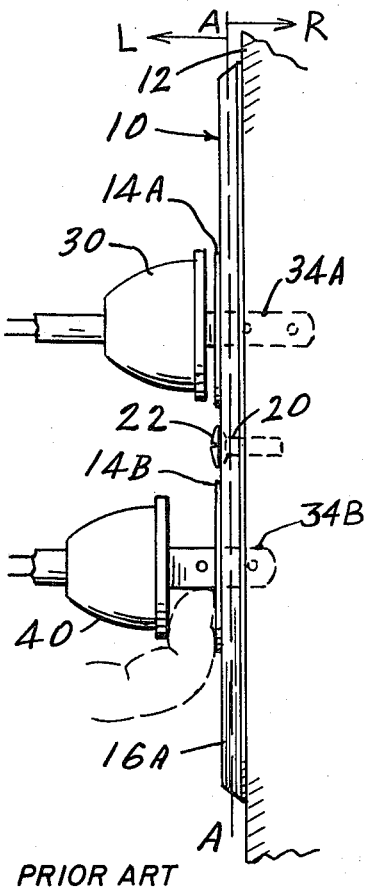
FIG. 3 is a side elevational view showing plugs inserted fully or completely in a standard electrical outlet.

The subject invention is a safety cover for a wall type electrical outlet of the type that is adapted to receive an electrical appliance plug having male prongs utilized for insertion into correspondingly aligned female receptacles in said outlet. The wall outlet of this type serves as a means to complete an electrical circuit between the particular electrical appliance, to which a plug is connected, and the master electrical circuitry connected with the power source. In particular, the subject invention is essentially a cover plate which is adapted to be installed over the face plate (or in place thereof) of the electrical outlet. Means of one type or another are integrally appended to the cover so as to permit the cover plate to be semi-permanently affixed to such outlet plate or the receptacle such that it cannot be readily removed by children.

The subject cover plate has openings therein of appropriate size and configuration and location to receive therethrough the respective appliance plugs so that respective plug prongs can be fitted through such openings to reach the corresponding female receptacle for insertion therein. Surrounding the outer perimeter of each such opening is a hooded tunnel-like appendage integrally affixed over each 21 opening such that the outer peripheral surface of said appendage is substantially aligned with the outer perimeter of each corresponding cover plate opening. This hood appendage is just wide enough to receive the appliance plug body. By such latter structural appendage, each plug opening in the subject cover plate essentially has a cylindrically shaped hollow bell-shaped tunnel projecting outwardly away from the cover plate surface. This tunnel-like appendage is of a diametrical extent that is sufficient to receive the widest girth and diameter of any conventional appliance plug that is to be inserted in the electrical outlet.

The subject cover plate can either be substituted in place of the existing outlet cover plate by removing the existing plate and inserting the subject cover plate in place thereof. For this purpose, appropriate screw openings are manufactured in said cover plate so that the subject cover plate can be affixed to the front of receptacle on the wall. If the subject cover plate serves as a separate plate to be affixed over the existing cover plate, then in such circumstances, there are means to append it in some integral fashion to the underlying receptacle cover.

Once the subject cover plate is so positioned, the appliance plug is inserted into the corresponding tunnel appendage surrounding the individual receptacle opening and the prongs are inserted in mating fashion into the female inserts, and as so inserted into the surrounding tunnel member, the plugs and prongs are covered against a child's attempts to pry the same loose from an outlet. Under such structural arrangement, if the plug is pulled out by grasping and pulling the cord, the child is unable to grab the prongs while they are still partially or fully inserted, as the length of the tunnel appendage is at least as long as the prongs. Thus, the prongs are partially inserted and they cannot be touched until they are completely pulled out beyond the outer end of the tunnel.

DESCRIPTION OF PREFERRED EMBODIMENT

Figure 1:
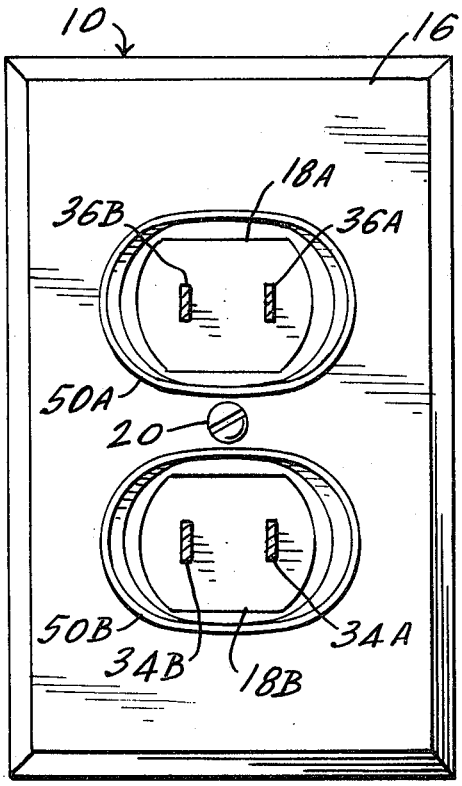
FIG. 1 is a front elevational view of the subject device incorporating the subject invention.

Referring now to the drawings in which a preferred embodiment of the subject invention is shown, an electrical outlet covering device 10 is shown in FIG. 1. For purposes of further orientation in describing the preferred embodiment herein, the word "left" or "outer" will refer to those spatial areas which are on the side of the wall or outlet opposite to that side containing the electrical wiring and other related fixtures. Conversely, the words "right" or "inside" will refer to that side of the wall or outlet which is on the same side as such wiring or fixtures. Moreover, the front of the receptacle will be those areas to the left illustrated by the "L" arrow in FIG. 3, while the back will be referred to those areas to the right of vertical line A—A in FIG. 3, illustrated by the "R" arrow at the top of the drawing. Moreover, the line A—A will be that line that corresponds to the imaginery longitudinal central axis of the cover plate for outlet 10, which axis A—A is generally oriented vertically up and down when cover plate 10 is affixed vertically against the wall 12.

Attention is directed particularly now to the drawing in FIG. 3, as a basis for reference and a point of departure, a conventional wall outlet 10 is shown. Specifically, an outlet 10 of conventional structure is shown as attached to vertical wall 12. Integrally affixed in wall 12 are a pair of vertically aligned plug receptacles 14A and 14B. The outlet cover 16A has appropriately placed circular openings to expose the plug receptacles 14A and 14B to the left side of the wall 12, as represented. A circular opening 20 in the middle of the cover plate 16A is adapted to receive a screw 22 to lock the cover plate 16A against wall 12. Conventional plugs 30 and 40 with respective dual male prong members 34A and 34B are adapted for insertion into the female outlets 14A and 14B, as shown.

As described above and shown, the outlet 10 is of ordinary construction, and the cover plate 16A is similarly a typical cover plate utilized on wall type outlets described. In this regard, as noted in FIG. 3, the plug 40 is shown partially engaged only, with a portion of prongs 34B exposed such that a finger can be placed between the plug and the cover 16A so as to touch the partially inserted prong 34B. This potential situation, as graphically represented, is the danger the subject invention is conceived to prevent.

Figure 2:
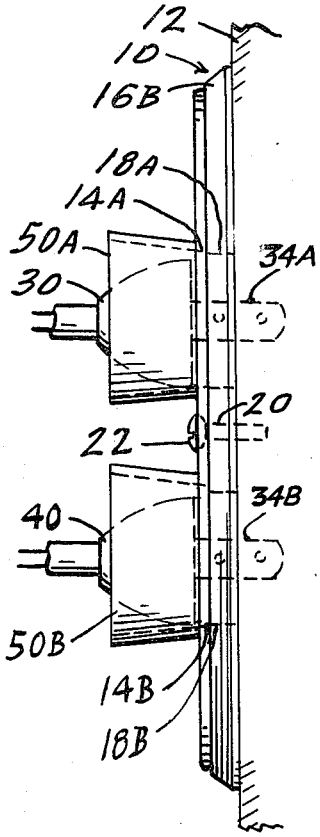
FIG. 2 is a side elevational view of the subject device.

Reference is now made to FIGS. 1 and 2 which show a preferred embodiment of the subject invention. In particular, in FIG. 2 the basic wall type outlet as shown in FIG. 3 is again generaly represented in FIG. 2, however, the only difference between the structures shown in FIGS. 2 and 3 is the outlet cover. In FIG. 3, as indicated, the outlet cover 16A is of conventional structure, as indicated above, while the outlet cover 16B in FIG. 2 differs by incorporating the structural embodiments of the subject invention, as more particularly described hereinbelow.

Relative to the outlet shown in FIG. 2, each plug 30 and 40 is adapted for direct connection to an electrical appliance. The male prong pairs 34A and 34B of each such plug, as shown, are simply inserted into the openings to complete the electrical circuit to the connected appliances. Again, in referring to FIG. 2, plug 30 as indicated for the upper socket, is firmly emplaced, with the plug insulation covering firmly impressed up against the socket openings in the cover plate 16B.

The outlet cover plate 16B shown in FIG. 2 incorporating the subject invention is of general rectangular configuration, however, this rectangular constructional configuration thereof can vary to any desired shape, when viewed in a planer position. In addition, machined or otherwise molded into the subject cover plate 16B are one or more openings 18A and 18B of generally circular configuration, which openings are spaced and otherwise positioned so as to be aligned with the corresponding female receptacles 14A and 14B in the outlet 10. Such circular openings 18A and 18B are obviously positioned so that the enlarged ends of plugs 30 and 40 can reach through cover plate 16B into place for appropriate insertion of the respective prong members into the intended female receptacles 14A or 14B.

As in the case of the conventional plate 16A, a relatively small circular screw opening 20 is situated in the central part of cover plate 16B, and this circular opening 20 is threaded to appropriately receive a mating screw 22 for securing the cover plate 16B over the female receptacles 14A and 14B, in similar fashion as the conventional cover plate 16A.

The cover plate 16B shown in FIGS. 1 and 2 has hollow tunnel shaped covers 50A and 50B respectively extending outwardly, to the left and from the wall 12, as particularly shown in FIG. 2. More specifically, one end of the hollow tunnel shaped member 50A is aligned with the outer periphery of opening 18A on cover plate 16B so that the tunnel shaped member 50A serves as an integral extension of such circular opening 18A for receptacle 14A. Similarly, the opening 18B for receptacle 14B has a tunnel member 50B extending outwardly in similar fashion as an integral extension therof. Tunnel members 50A and 50B thus essentially serve as hollow and generally cylindrical protective covers projecting outwardly from the wall (and to the left as shown) and as such the outer periphery of the circular outlet openings in the manner represented. As thusly constructed, tunnel members 50A and 50B are adapted to receive in their respective hollow inner spaces, plugs 30 and 40, as shown in FIG. 2. As shown, the plugs 30 and 40 as inserted inside the hollow tunnel members as substantially covered on all sides so that it is extremely difficult for a person to remove a plug other than by grasping it near the rear part thereof where the plug is joined to the appliance cord. As a result of this latter feature, while the plug is in a tunnel member, one cannot place his fingers on partially inserted prongs, since the tunnel is usually longer than the prongs. Thus, there is no danger of children placing their fingers on partially inserted prongs. Moreover, it is difficult for children to insert plugs through such tunnel members.

Figure 4:
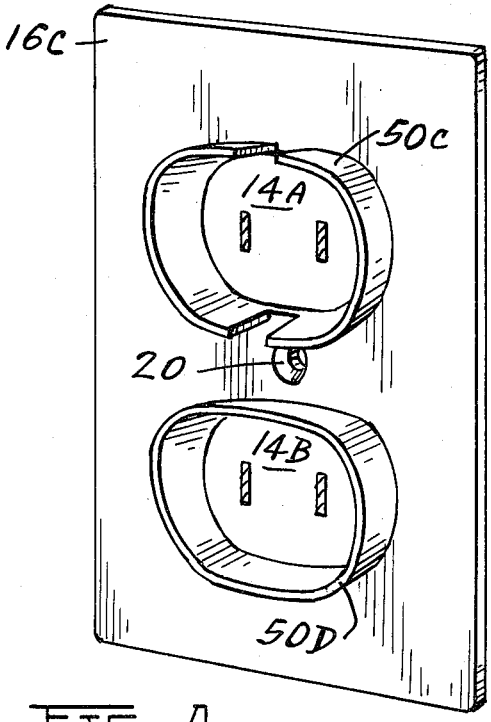
FIG. 4 is a perspective view of the subject invention from a generally frontal view showing an alternate embodiment.

In FIG. 4, the subject cover plate 16C is shown from a frontal view, and as noted, one possible alternate structural arrangement for one of the tunnel members is to provide spaced gaps on the upper and lower part of the tunnel, as shown in the case of upper tunnel member 50C. These spaced gaps facilitate removal of the plug from the socket, but still are of sufficient narrow space so as to prevent even a little finger from being placed down to the inside of the tunnel 50 and onto any exposed prongs in the partially inserted plug. In the embodiment in 16C, this latter plate is also substituted for the regular plate 16A.

Figure 5:
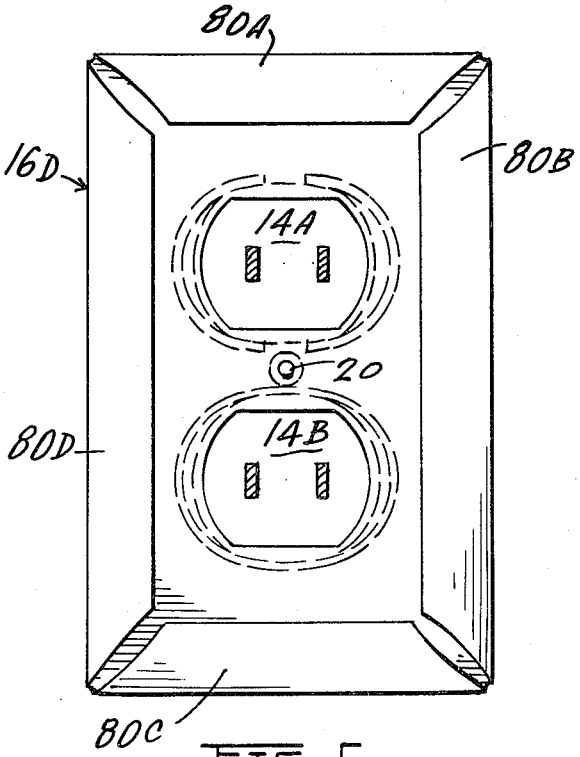
FIG. 5 is a rear elevational view of the subject device showing an alternate attachment structure.

Another possible embodiment of the subject invention is shown in FIG. 5, in which the plate 16D is constructed for superimposition over an existing conventional cover plate 16A. Plate 16D is constructed with flaps 80A, 80B, 80C and 80D on the respective back sides of the plate 16D so that plate 16D can be appended on its back side cover the front of plate 16A. In such an embodiment, the cover plate 16A as installed is removed temporarily and the superimposed plate 16D, with its attendant tunnel members on the front is inserted over the regular plate by inserting the flaps 80A, 80B, 80C and 80D around the outer edges of plate 16A. Plate 16D is contradistinguished from those shown in FIGS. 2, 3, 4, which latter embodiments are actual cover plates themselves which supplant the conventional cover plate 16A, as described below. Plate 16D is simply superimposed over the regular cover plate.

I claim:

1. A protective covering device for electrical plugs with two prongs for insertion in a wall affixed electrical outlet, said protective device comprising:

(a) a plate member, said plate member having one or more openings, extending therethrough to receive a male electrical appliance plug for insertion into the outlet;

(b) hollow and open ended tunnel members affixed over each of said openings in said plate member, said hollow tunnel members being axially aligned to receive an appliance plug therethrough for insertion of the respective plug through said corresponding plate openings into the electrical outlet, at least one of said tunnel members having gaps in its upper and lower periphery to allow access to a portion of a plug when inserted in the outlet, and wherein the width of said gaps is less than the distance between the two prong members;

(c) means to affix said plate member to the electrical outlet.

2. A protective covering device for partially covering electrical plugs with two prongs for insertion in a wall affixed electrical outlet, said protective device comprising:

(a) a plate member, said plate member having one or more openings extending therethrough to receive a male electrical appliance plug for insertion into the electrical outlet;

(b) hollow tunnel members open at each end thereof and affixed over each of said openings in said plate member, each said hollow member being aligned such that one end thereof lies flush against the corresponding receptacle opening and surrounds the outer circumference of said opening, thereby permitting an appliance plug to be inserted in said tunnel member so as to reach said outlet, at least one of said tunnel members having gaps in its upper and lower periphery whereby there is access to a plug while it is inserted in the tunnel, and wherein the width of each of said gaps is less than the distance between the two prongs members on said plug;

(c) means to affix said plate member to the electrical outlet.

3. A protective covering device as described in claim 2 in which said plate is of rectangular configuration.

4. A protective covering device integrally affixed to an electrical outlet coverplate for partially covering electrical plugs with two prongs for insertion in a wall affixed electrical outlet, said protective device comprising:

(a) a plate member, said plate member having one or more openings extending therethrough to receive a male electrical appliance plug for insertion into the electrical outlet;

(b) hollow tunnel members open at each end thereof and affixed over each of said openings in said plate member, each said hollow member being aligned such that one end thereof lies flush against the corresponding receptacle opening and surrounds the outer circumference of said opening, thereby permitting an appliance plug to be inserted in said tunnel member so as to reach said outlet, at least one of said tunnel members having gaps in its upper and lower periphery whereby there is access to a plug while it is inserted in the tunnel, and wherein the width of each of said gaps is less than the distance between the two prong members on said plug;

(c) means to affix said plate member to the electrical outlet.

* * * * *